US005996695A

United States Patent [19]

Koleilat et al.

[11] Patent Number: 5,996,695

[45] Date of Patent: Dec. 7, 1999

[54] METHOD AND APPARATUS FOR SEALING BETWEEN CASING AND WELLHEAD CONNECTOR STRUCTURE

[75] Inventors: Bashir M. Koleilat, Spring; David E. Cain, Houston, both of Tex.

[73] Assignee: FMC Corporation, Chicago, Ill.

[21] Appl. No.: 09/306,525

[22] Filed: May 7, 1999

Related U.S. Application Data

[60] Provisional application No. 60/084,750, May 8, 1998.

[51] Int. Cl.[6] ..... E21B 33/04

[52] U.S. Cl. ..... 166/382; 166/85.3; 166/88.2; 166/88.3; 166/383; 166/387; 277/323

[58] Field of Search ..... 166/75.13, 75.14, 166/85.1, 85.3, 85.5, 88.2, 88.3, 382, 387; 277/323, 343

[56] References Cited

U.S. PATENT DOCUMENTS

| | | | |
|---|---|---|---|
| 1,926,856 | 9/1933 | Leman | 166/88.2 |
| 3,438,654 | 4/1969 | Jackson, Jr. et al. | 166/88.3 X |
| 5,205,356 | 4/1993 | Bridges et al. | 166/85.1 |
| 5,257,792 | 11/1993 | Putch et al. | 166/387 X |
| 5,332,043 | 7/1994 | Ferguson | 166/379 |

*Primary Examiner*—George Suchfield
*Attorney, Agent, or Firm*—Gary L. Bush; Mayor, Day, Caldwell & Keeton L.L.P.

[57] ABSTRACT

A method and apparatus for installing a metal annular seal (54) between the outer rough surface of a casing member (11) which has had a portion thereof cutaway with a remaining portion projecting upwardly from the upper end of a casing head (12). A slip installation tool (18) mounted on the upper end of the casing head (12) carries a slip assembly which includes segmented slips (42), a bushing (22), and a cam member (42). The slip installation tool (18) secures the slips (40) about the outer rough surface of the casing (11) as shown in FIGS. 7 and 8 with bushing (22) acting as a supporting base or foundation to oppose the forces from the camming action because of support from lock down screws (24). After mounting of the slip assembly about the casing (11), the installation tool (18) is removed, and the metal seal (54), formed of a relatively soft metal material, is mounted over the extending end of the casing (11). Positioning of the tubing head (50) on the casing head (12) as shown in FIGS. 14–16 deforms the metal seal (54) into metal-to-metal sealing relation between the outer rough surface of casing (11) and the inner frusto-conical sealing surface (96) of the tubing head (50).

16 Claims, 10 Drawing Sheets

METHOD AND APPARATUS FOR SEALING BETWEEN CASING AND WELLHEAD CONNECTOR STRUCTURE

RELATED APPLICATION

This application claims priority from Provisional Application 60/084,750 filed on May 8, 1998.

BACKGROUND OF THE INVENTION

1. Field of the Invention

This invention relates to a method and apparatus for sealing between a tubular member and a wellhead structure from which the tubular member is suspended, and more particularly to an apparatus and method for sealing between the upper end of a well casing stub having a generally rough unfinished outer surface and a tubing head or a Christmas Tree adapter, for example.

2. Background of the Invention

Casing strings are normally suspended from a wellhead assembly. The wellhead assembly includes a casing head, which with a casing hanger, supports a casing string which extends into the well. A casing string may extend upwardly from the casing head higher than a preferred height for installation of a tubing head about the casing and with connection to the casing head. The upper extension of the casing is called a "casing stub". Normal installation includes providing a metal-to-metal seal between the exterior casing stub wall and an interior surface of the tubing head. Normal installation is accomplished with a finished exterior of the casing stub so that sealing with a metal-to-metal seal is effective. A seal is necessary between the OD of the casing stub and the ID of the tubing head to prevent possible hydrocarbon spillover from the producing strings inside the casing to the annulus outside of the casing. The tubing head which fits about the casing stub supports the production tubing which extends into the casing to a hydrocarbon pay zone in the well.

During completion operations it may be desirable or necessary under various conditions, such as when a casing string is stuck downhole, to cut off or remove an upper longitudinal section of the casing string which projects from the upper end of the casing head. When an upper section of the casing is cut off, a projecting portion of the casing remains which projects above the casing head. It is not finished. Its outer surface may be rough in texture with a Root Mean Square (RMS) roughness of about 64 RMS, but the roughness may be as high as 250 RMS. Relatively hard metal seals are used for sealing between the finished or relatively smooth OD of the projecting upper end section of a casing and the adjacent ID sealing surface of a tubing head. A hard metal seal may not be acceptable in sealing about unfinished or relatively rough textured casing due to serrations on the casing caused by the sharp seal teeth.

Regular length casing which has not been cut has a sealing surface which has been finished or machined with a RMS roughness less than about 32. Therefore in the past when a top end of a casing has been cut off to produce a casing stub, it has been common to machine or otherwise finish the outer surface of the casing stub to provide a smooth, finished surface for a metal-to-metal seal to be installed between the casing stub and the tubing hanger, particularly when a relatively hard metal seal is used.

Installation of a metal seal is furthermore desired to be accomplished without regard to the particular arrangement of the installed casing head, because different casing head arrangements are provided by different manufacturers.

IDENTIFICATION OF OBJECTS OF THE INVENTION

It is a primary object of the invention to provide an apparatus and method for the installation of a relatively soft metal seal which is effective to provide a metal-to-metal seal between the relatively rough outer surface of a casing stub and a tubing head without requiring any special finishing or machining of the exterior of the casing for effective metal-to-metal sealing between the OD of the casing stub and an interior surface of the tubing head.

A further object of the invention is to provide an apparatus and method by which a metal-to-metal seal is provided between the casing stub and the tubing head where the seal is supported solely from the casing stub, and not from the casing head.

SUMMARY OF THE INVENTION

The present invention is directed particularly to an apparatus and method for sealing between the exterior of a casing stub which extends upwardly from a casing head. The casing stub has a generally rough unfinished outer surface. The metal-to-metal seal arrangement of this invention seals between the rough outer surface of the casing stub and an adjacent opposed inner surface of a tubing head which is secured to the casing head. The method and apparatus include a slip assembly which includes a slip ring, a cam bowl member for engaging the slip ring, and a bushing which initially locates the slip ring vertically on the casing stub and supports the slip ring and the cam ring while opposing the force exerted by a hydraulic swaging tool against the cam member while urging the slip ring into tight gripping engagement with the outer surface of the casing. The bushing could serve as a secondary seal or test seal if desired.

The wellhead assembly has an upper housing or casing head which receives the casing coaxially by means of a casing hanger and defines an annulus therebetween. The special slip swaging tool is positioned over the upper end of the casing stub for engaging the cam ring bowl of the slip assembly to force the slip ring to grip the casing with support from below by the supporting bushing. Then, the slip swaging tool is removed with the result that the slip ring, the cam ring bowl and the reaction support bushing remain in position about the casing. The slip ring is in position to act as the sole lower support for supporting and positioning the metal seal on the casing stub.

Next, the tubing head is placed over the cam ring, slip ring and bushing in order to move the bushing downwardly on the casing stub and below the slip ring with the result that the slip ring and cam bowl ring are supported entirely from the casing stub itself and not the casing head. The tubing head is then removed.

Next, a relatively soft metal seal is positioned over the upper end of the casing stub and is moved downwardly until it abuts the cam ring. In this position, a tubing head or similar device, such as a spool or adapter for a Christmas tree, is positioned over the upper end of the casing stub such that it lands on the exterior profile of the seal. A measurement is made of the distance between the bottom surface of the tubing head and the top surface of the casing head. The tubing head is removed, and the seal is removed. A shim is provided over the top end of the cam ring to insure that when the seal is reinstalled and the tubing head is reinstalled, the distance between the upward hub face of the casing head and the bottom hub face of the tubing head is a predetermined distance.

Finally, a connector squeezes a lower flange of the tubing head and an upper flange of the casing head together, thereby causing the flange faces of the tubing head and the casing head to abut each other. During the connecting or squeezing operation, the tubing head moves down by the predetermined distance referred to above while a camming surface of the tubing head drives the soft metal-to-metal seal radially inwardly into the casing stub. The seal is prevented from axial movement along the casing stub, because the slip ring, cam ring and shim cannot move axially due to the fact that the slip ring tightly grips the exterior of the casing stub.

Thus, it is a feature of the present invention to provide an apparatus and method for installing a soft metal seal for sealing between the generally unfinished outer surface of a casing stub which extends upwardly from a casing head and an opposed inner surface of a tubing head which is secured to the casing head and without any special machining or finishing of the exterior of the casing stub required prior to installation of the relatively soft metal seal.

It is a further feature of the invention that an apparatus and method are provided which includes a seal, and a slip arrangement secured to the rough casing before the relatively soft metal seal is positioned over the casing, where the slip arrangement supports the metal seal at a precise position on the casing without any support from the casing head.

Another feature of the invention relates to a swaging tool which is used to position the bushing and the slips at a precise location relative to the hub face of the casing head thereby providing accurate positioning of the slip assembly to insure later adequate energizing of the metal seal on the casing stub after a shimming procedure and after makeup of a connector between the tubing head and the casing head.

Other objects, features, and advantages of the invention will become more apparent upon reference to the following specification and drawings.

BRIEF DESCRIPTION OF THE DRAWINGS

The objects, advantages and features of the invention will become more apparent by reference to the drawings which are appended hereto and wherein an illustrative embodiment of the invention is shown, of which.

DESCRIPTION OF THE INVENTION

Figure 1:
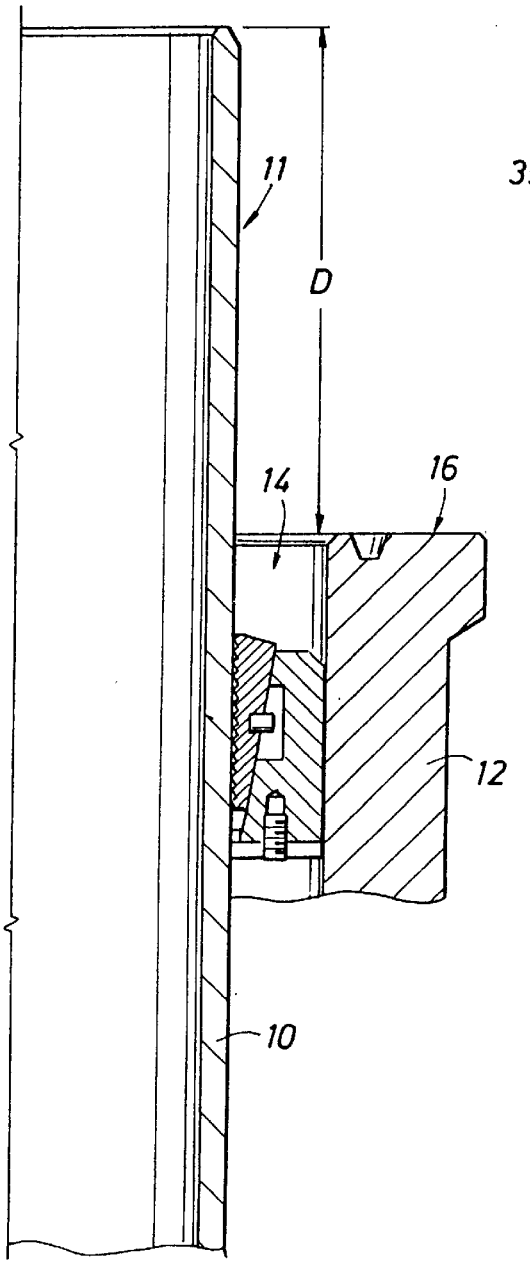
FIG. 1 is an enlarged longitudinal sectional view of a casing stub which projects upwardly from the upper surface of a casing head of a wellhead assembly in which a casing is installed with a casing hanger and defines an annulus between the casing and the casing head.

FIG. 1 illustrates a casing string 10 (for example having an O.D. of 9⅝") which is supported in a casing head 12 by means of a casing hanger 14. A stub or exterior of the casing string 10 extends above the casing head 12. It is referred to herein sometimes as a casing stub. The height "D" of the casing stub from the top of the casing hub to the hub face 16 is preferably 11.0"±¼" in a preferred embodiment of the method for running a FX RCMS seal for a 9⅝" casing. A preferred FX RCMS seal is of stainless steel AISI 316 and is characterized by a UNS Name of 531600, a Rockwell "B" of 83 HRB Max and a yield strength of 30,000 psi min. The 11" is measured from the top of the hub face 16 and is marked on the casing so that the casing stub 11 is of the proper height above hub face 16. The casing stub 11 should be prepared with a bevel and wire brushed on its OD, preferably with a pneumatic wire brush. The OD should be cleaned to base metal as much as possible, but a grinder should not be used on the casing stub 11 to clean off the scale.

Next the OD tolerance range of stub 11 is determined by using the procedure as outlined in Table 1 below. A 0.15" shim is first used, then gages 1, 2, and 3 are employed to determine bowl, shim and seal particulars consistent with the OD of the stub 11.

TABLE 1

| CSG. TOL. RANGE W/CORRESPONDING SLIPS, BOWL, SHIM AND FX RCMS SEAL | | | | | | | | |
|---|---|---|---|---|---|---|---|---|
| CSG SIZE | LOW TOL SHIM | GAGE #1 | GAGE #2 | GAGE #3 | SLIPS | BOWL | SHIM | SEAL |
| 9.721/ 9.685 | NO GO | NO GO (1) | NO GO | NO GO | HIGH TOL. | #1 | HIGH TOL. | HIGH TOL. |
| 9.684/ 9.649 | NO GO | GO | NO GO (1) | NO GO | HIGH TOL. | #2 | HIGH TOL. | HIGH TOL. |
| 9.648/ 9.613 | GO | GO | GO | NO GO (1) | LOW TOL. | #3 | LOW TOL. | LOW TOL. |
| 9.612/ 9.577 | GO | GO | GO | GO | LOW TOL. | #4 | LOW TOL. | LOW TOL. |

NOTE 1:- IF GAGE GOES OVER THE CASING, ASSUME THE CASING IS IN THE NEXT LOWER TOLERANCE RANGE.
GAGE SIZES:-
LOW TOL. SHIM ID 9.663"/9.673"
GAGE #1 ID 9.686"/9.687"
GAGE #2 ID 9.650"/9.651"
GAGE #3 ID 9.614"/9.615"

Figure 3:
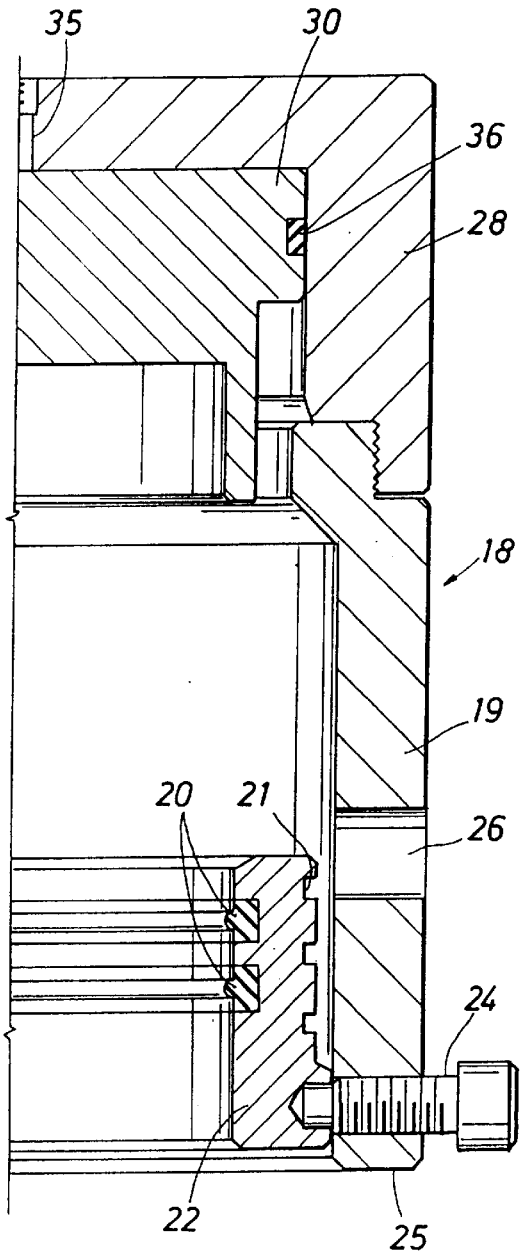
FIG. 3 is a sectional view of a swaging tool with a seal bushing installed by means of cap screws and without outer diameter S-seals installed, where the tool is ready to be installed over the casing stub.

Next, as illustrated in FIG. 3, a swaging tool 18 is provided. FS seals 20 are assembled in a reducer bushing 22 which is secured via the bottom end of swaging tool 18 by means of fasteners such as cap screws 24. A generous layer of copper coat grease is applied over the screw threads, the tip of the screws and the locking holes. Preferably, sixteen cap screws are provided which are made up band tight. The screws are considered made up when the bottom of the cap screws head 24 is about one inch from the OD of 18. S-seals on the OD of bushing 22 are not installed at this time in the slots 21 provided for same.

Figure 2:
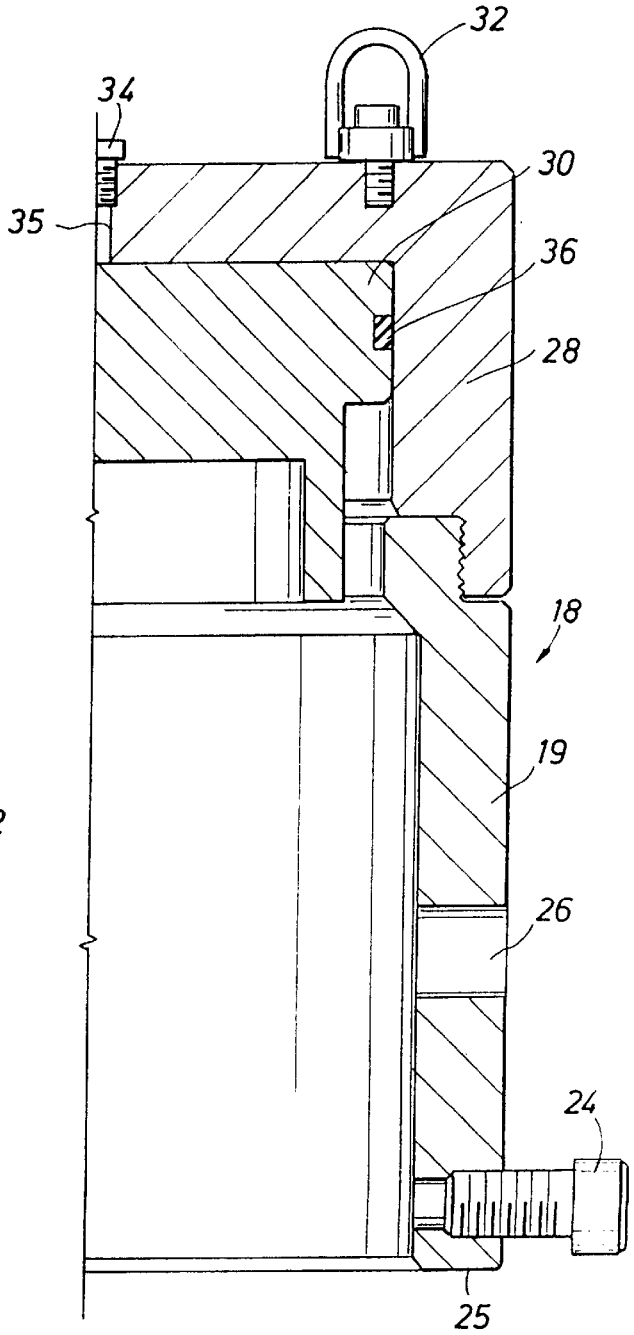
FIG. 2 is a sectional view of a swaging tool for installing a bushing and a slip ring about the casing stub.

FIGS. 2 and 3 illustrate the swaging tool which includes a lower tool housing 19 having a visual port 26 provided therein. An upper tool housing 28 is threadably secured to lower tool housing 19. Three one hundred sixty degree pad eyes 32 are provided for lifting the swaging tool 18 onto and from casing stub 11. A piston 30 is provided within the upper tool housing 28, and a sealing polypak 36 provides a seal for piston 36 to be reciprocated by pressurized hydraulic fluid. In the method of installation, the piston 30 of the swaging tool 18 is placed as high as possible in the upper tool housing 28. A pipe plug 34 is installed in pressure port 35 to maintain the piston 30 in place.

Figure 4:
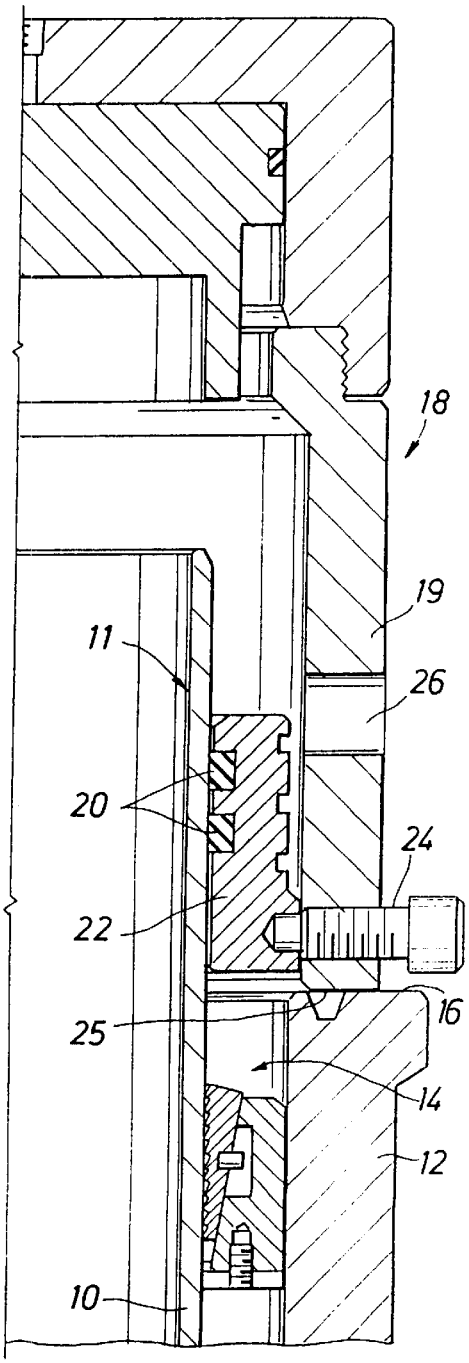
FIG. 4 is a sectional view of the swaging tool of FIG. 2 installed over the casing stub and landed on the hub face of the casing head with the bushing snubbed about the exterior of the casing stub.

As illustrated in FIG. 4, the swaging tool 18 is placed over the top and around casing stub 11. A thick layer of clean grease is applied to the FS-seals 20 and to the OD of the casing stub 11. As the tool 18 and seal bushing 22 are installed about casing stub 11, the tool 18 is placed with its bottom face 25 in face-to-face contact with hub face 16. If the weight of the tool 18 is not great enough to bring the tool 18 and bushing 22 to the position illustrated in FIG. 4, a drill collar or other weight may be applied to the top of tool 18 to overcome friction between the seals 20 and the outer surface of casing stub 11 in order that the tool face 25 is placed face-to-face on the hub face 16.

Next, the bushing 22 is unlocked from the tool 18 by fully unscrewing the sixteen one-inch socket head cap screws 24. The tool 18 is then removed by lifting it from the top of casing stub 11. The bushing is not disturbed from its position of FIG. 4. Friction between the FS seals 20 and the casing stub 11 temporarily maintains the bushing 22 in place.

Based on the measurements described above by reference to Table 1, the appropriately sized slips, bowl, FX RCMS seal element and shims are selected.

Figure 5:
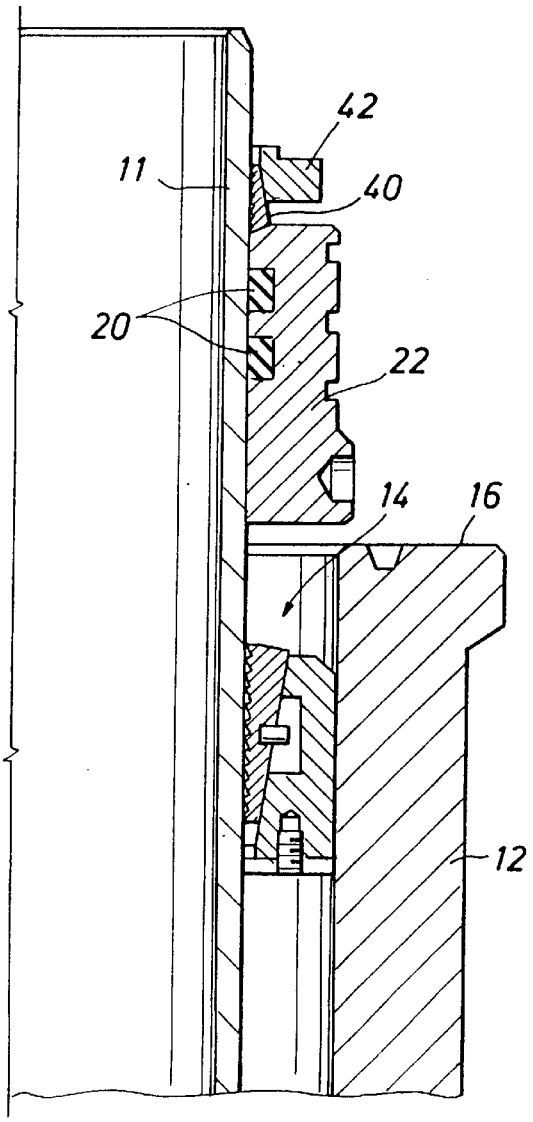
FIG. 5 is a sectional view of the casing stub after a slip ring and cam ring bowl have been installed over the casing stub and landed on the seal bushing.

As illustrated in FIG. 5, a segmented slip ring 40 is installed first about the OD of the casing stub 11, and then the cam bowl 42 is placed about an outer camming surface of slip ring 40.

Figure 6:
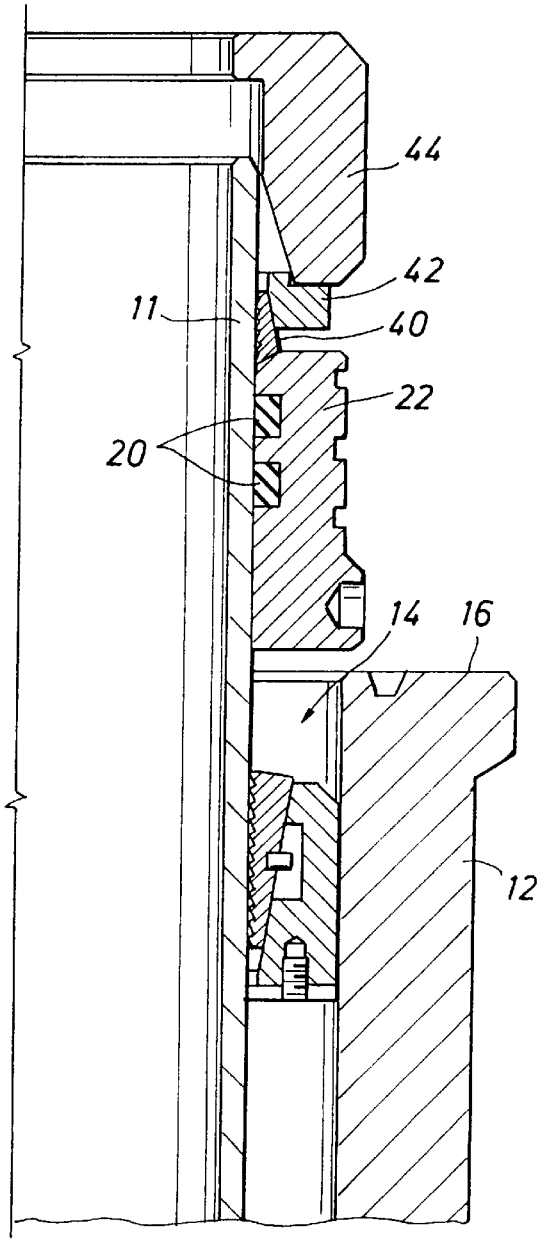
FIG. 6 illustrates an energizer ring that has been installed over the casing stub and landed on the cam ring bowl ready for energizing by means of the swaging tool.

Next, as shown in FIG. 6, an energizing ring 44 is placed over the top end of casing stub 11 and lowered until it contacts slip bowl 42. The bowl 42 is leveled to a horizontal position by placing a level on the ring 44 at two places spaced ninety degrees apart. The gap between the bottom of bowl 42 and the top of the bushing 22 is preferably between about 0.5" and 0.618".

Figure 7:
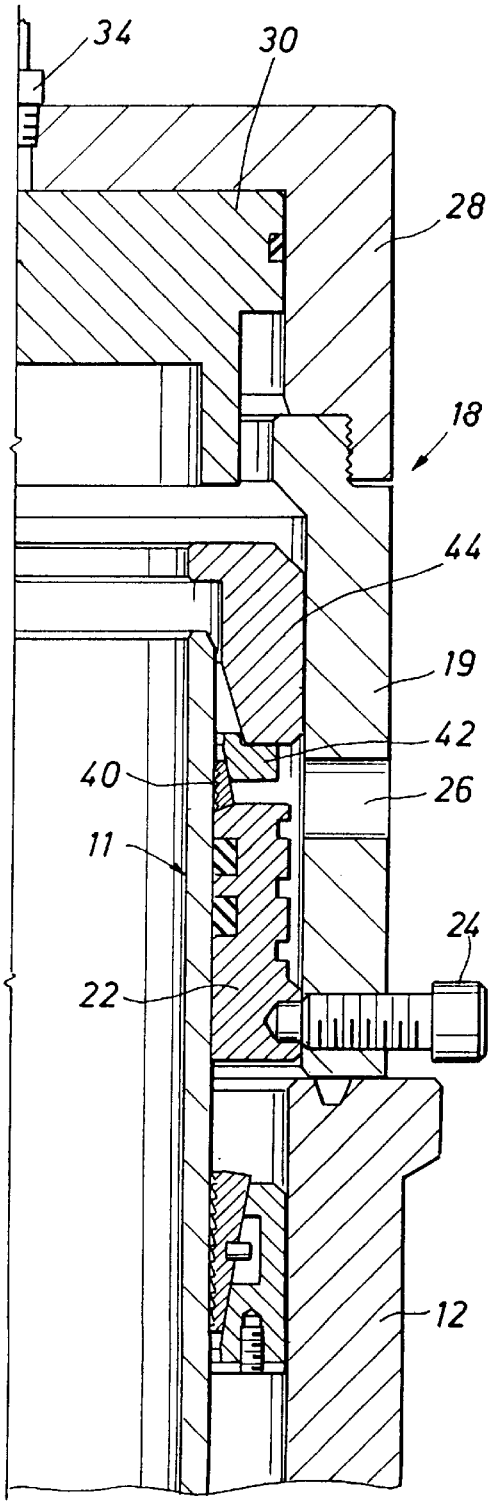
FIG. 7 illustrates the swaging tool of FIG. 2 installed over the casing stub, slip ring, cam ring bowl, and energizing ring for energization of the slip ring.

As shown in FIG. 7, the hydraulic swaging tool 18 is installed over the top of the combined casing stub 11, the slip ring 40, the slip bowl 42, and the energizing ring 44. One of the socket head cap screws 24 on the swaging tool 18 is removed to insure proper alignment with the bushing 22 as the swaging tool 18 is being installed. After alignment, all sixteen of the one-inch socket head screws 24 are inserted and tightened into a corresponding hole of the bushing. The screws 24 are made up hand tight. They are considered made up when the bottom of the cap screw head is approximately one-inch from the OD of the swaging tool 18. Previously, a generous layer of copper coat grease has been applied over the screw threads, the tip of the screws 24 and the sixteen holes in the bushing 22 prior to the installation of the swaging tool 18 If the bushing 22 has not been disturbed after the initial installation as described above, and the screws 24 and the holes of the bushing 22 have been greased properly, most of the screws 24 can be tightened by hand. However, Allen wrenches or other tools may be used to make up the screws 24 if necessary. Proper alignment of the screws 24 with the holes of the bushing 22 prevents damage to the bushing 22. If the bushing has been inadvertently disturbed, its height is adjusted until the holes line up vertically with the socket head cap screws 24 of the swaging tool 18.

Figure 8:
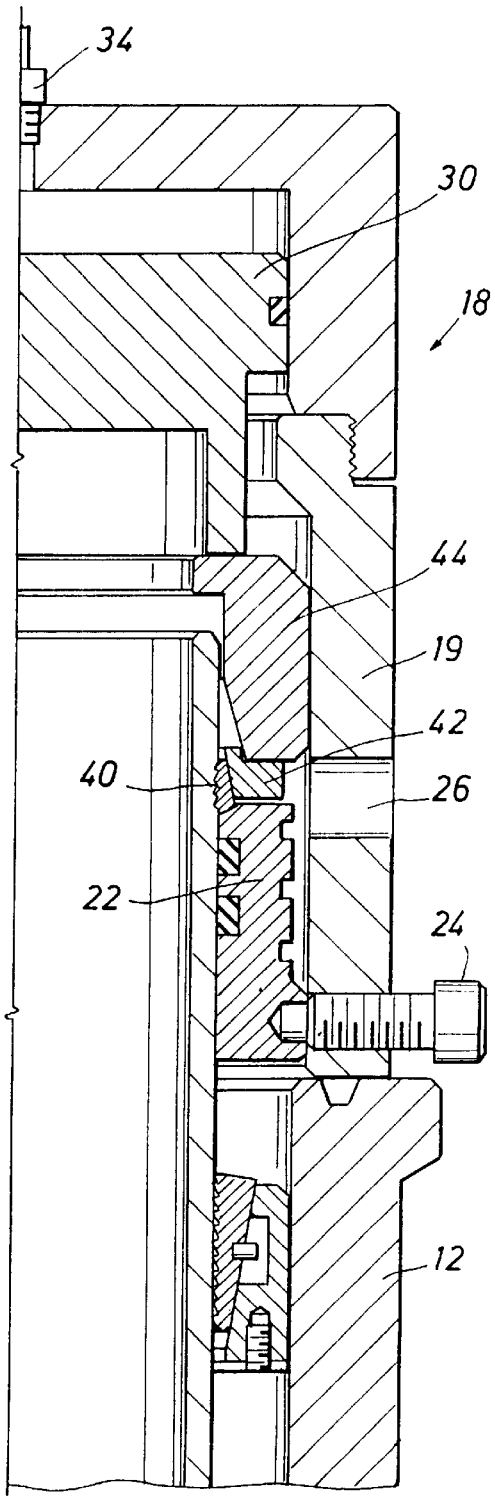
FIG. 8 illustrates hydraulic force being applied to the energizer ring for squeezing the slip ring radially inwardly into the OD of the casing stub, while the bushing is being held in place by cap screws through a wall of the swaging tool.

Next, referring to FIG. 8, the pipe plug 34 is removed and a hydraulic line (not illustrated) (rated to 5000 psi min) is applied to the pressure port from which the plug 34 is removed. The piston 30 forces ring 44 downward which causes slip ring 40 to be energized, that is, to be forged and locked around the casing 11. Pressure to a maximum level of 4700 psi is applied in increments of 1000 psi. The gap between the bottom of the bowl 42 and the top of bushing 22 is monitored via the four two-inch view ports 26. At 4700 psi, the gap is measured with feeler gages at four places at ninety degrees apart through the view ports 26. The pressure is relieved, and the gap is remeasured with feeler gages.

The pressure is increased as before to 4700 psi until the gap, with pressure relieved, does not change more than 1/32". The gap should stabilize after the third cycle of pressure. The reference to no change greater than 1/32" is merely a short hand way of insuring that the casing slip ring and bowl 42 are energized. A pressure greater than 4700 psi for energization should be avoided.

Next, pressure is relieved from swaging tool 18, and the hydraulic line is removed. The tool 18 is removed by unscrewing the sixteen socket head cap screws 24. The energizing ring 44 is removed. The slip ring 40 and bowl 42 should be fully energized.

Figure 9:
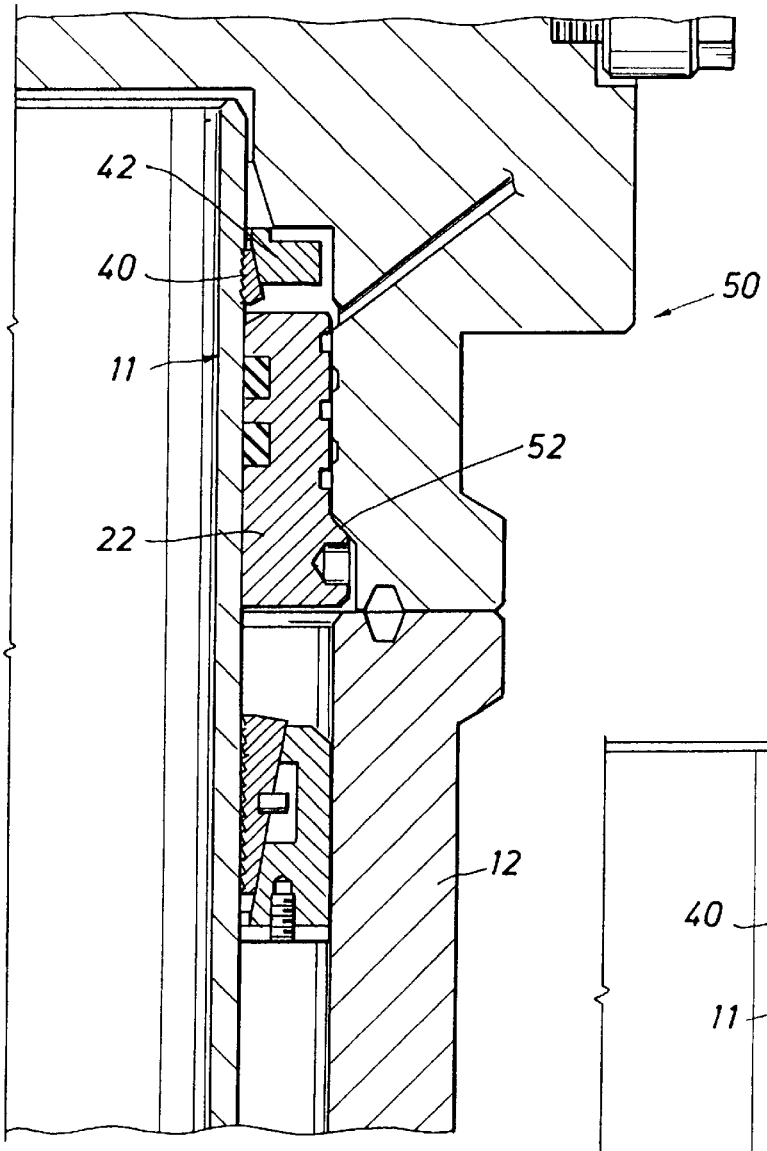
FIG. 9 illustrates that the swaging tool has been removed and that the bushing has been moved downwardly by a shoulder of the tubing head which has been landed over the casing stub.
Figure 10:
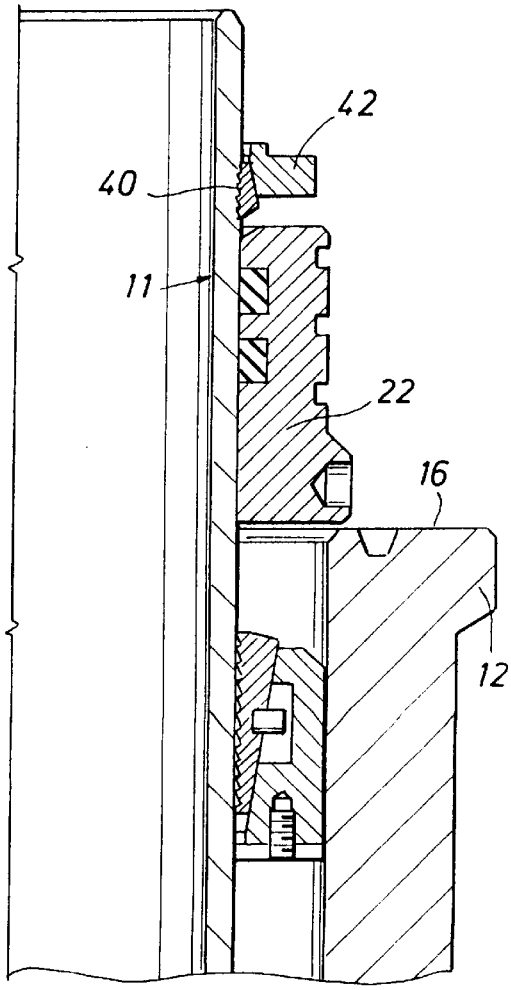
FIG. 10 illustrates that the tubing head has been removed and that the area above the cam slip bowl is cleaned without grinding.

Next, referring to FIGS. 9 and 10, with the S-seals still removed from reducer bushing 22, a tubing head 50 is landed over the casing stub 11, slip bowl assembly 42, and reducer bushing 22. As the tubing head 50 moves down onto the lower position, the bushing 22 is pushed down by contact of shoulders 52 between bushing 22 and tubing head 50. The tubing head 50 is then removed with the bushing installed on the casing stub 11. The tubing head is pulled straight up so as not to disturb the position of bowl 42 or ring 40.

Figure 12:
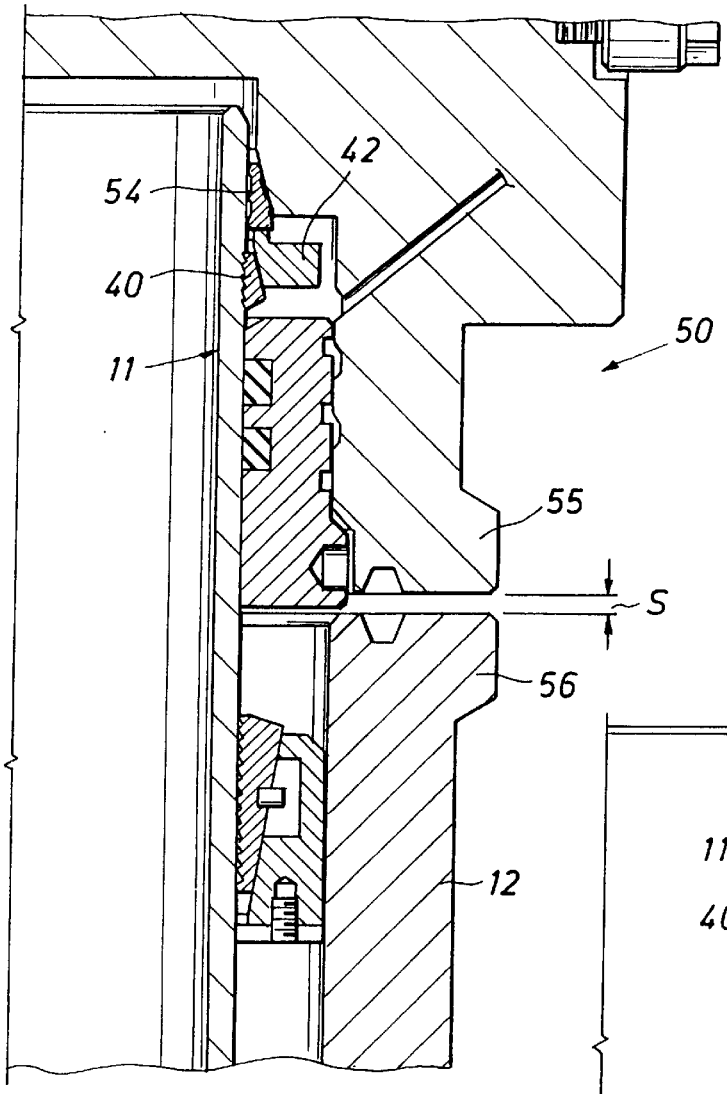
FIG. 12 shows that the tubing head is reinstalled over the casing stub and landed on the exterior surface of the metal seal in preparation for measuring the stand off between the bottom hub face of the tubing head and the top hub face of the casing head.
Figure 11:
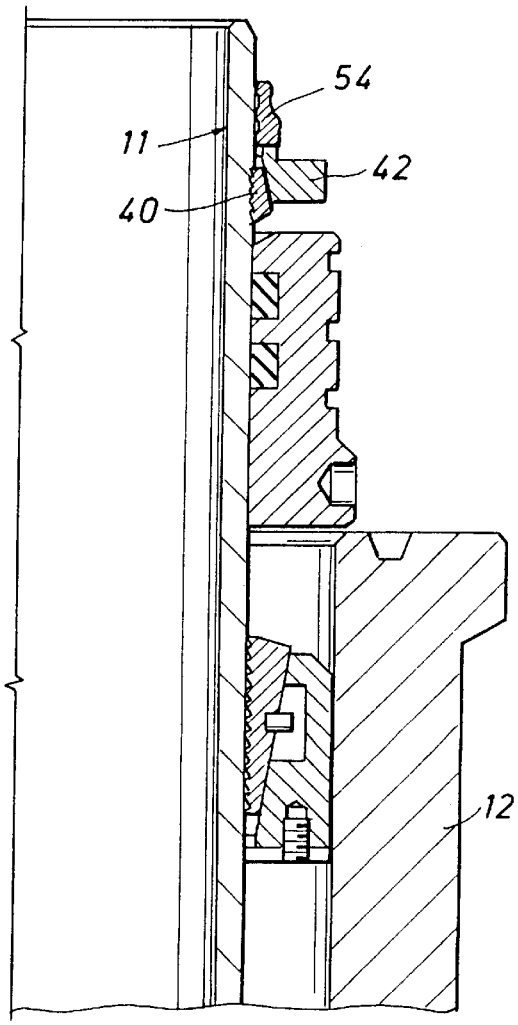
FIG. 11 illustrates that a relatively soft metal seal is installed over the casing stub and landed on the cam slip and cam ring bowl.

Next, as shown in FIG. 11, the selected FX RCMS seal 54 (the selection of which is described above by reference to Table 1) is placed over the casing stub and on the slip bowl 42. The small end of the taper of seal 42 is placed up. As illustrated in FIG. 12, the tubing head 50 is carefully lowered over the casing stub 11, slip ring 40 and bowl 42 and FX RCMS seal 54. The tubing head 50 is leveled, and then the stand off S at the interface between flanges 55 of tubing head 50 and flange 56 of casing head 12 is measured and recorded.

Next, the tubing head 50 and the FX RCMS seal element 54 are removed. Shims 60 that were selected as described above are installed between seal 54 and bowl 42. A stand off gap S of about 0.350" is preferred. The number of shims to install is found by subtracting the measurement recorded above from 0.350" and determining the number of 0.150" and 0.100" shims required for a minimum gap of 0.350".

Figure 13:
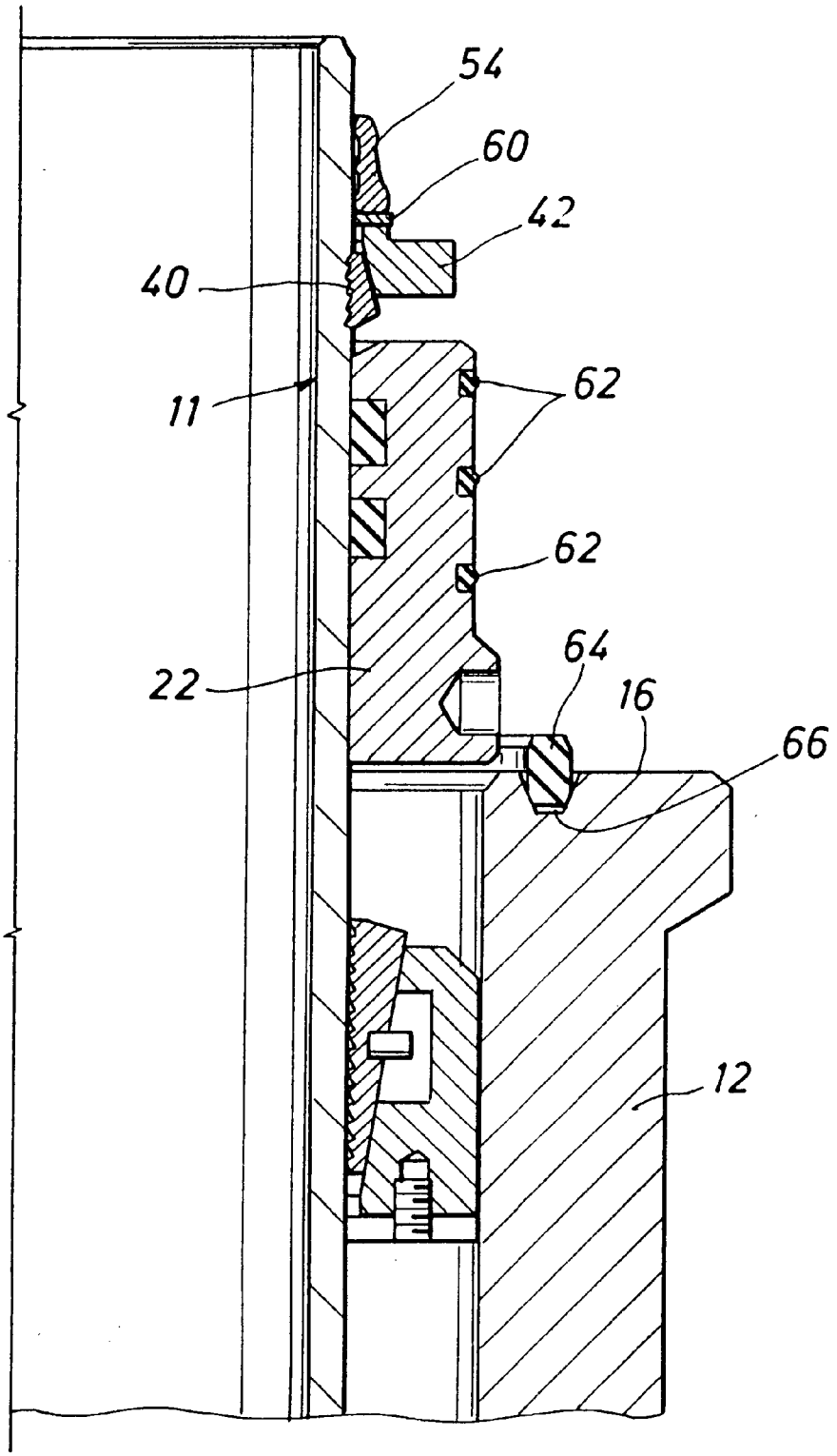
FIG. 13 shows that the tubing head has been removed and that a shim has been placed between the bottom of he metal seal and the top of the cam slip bowl and with a gasket installed in an API groove in the top face of the casing hub; S-seals have also been installed on the bushing O.D.

As shown in FIG. 13, with the sealing area clean and greased, the FX RCMS seal 54 is installed over the casing stub 11 on the slip 40, bowl 42 and shim assembly 60. A layer of copper coat grease is applied to the entire surface of the FX RCMS seal element 54. S-seals 62 are installed on the OD of bushing 22, and a layer of clean grease is applied on the seals. A BX gasket 64 is installed in the API groove 66 of the hub face 16.

Figure 14:
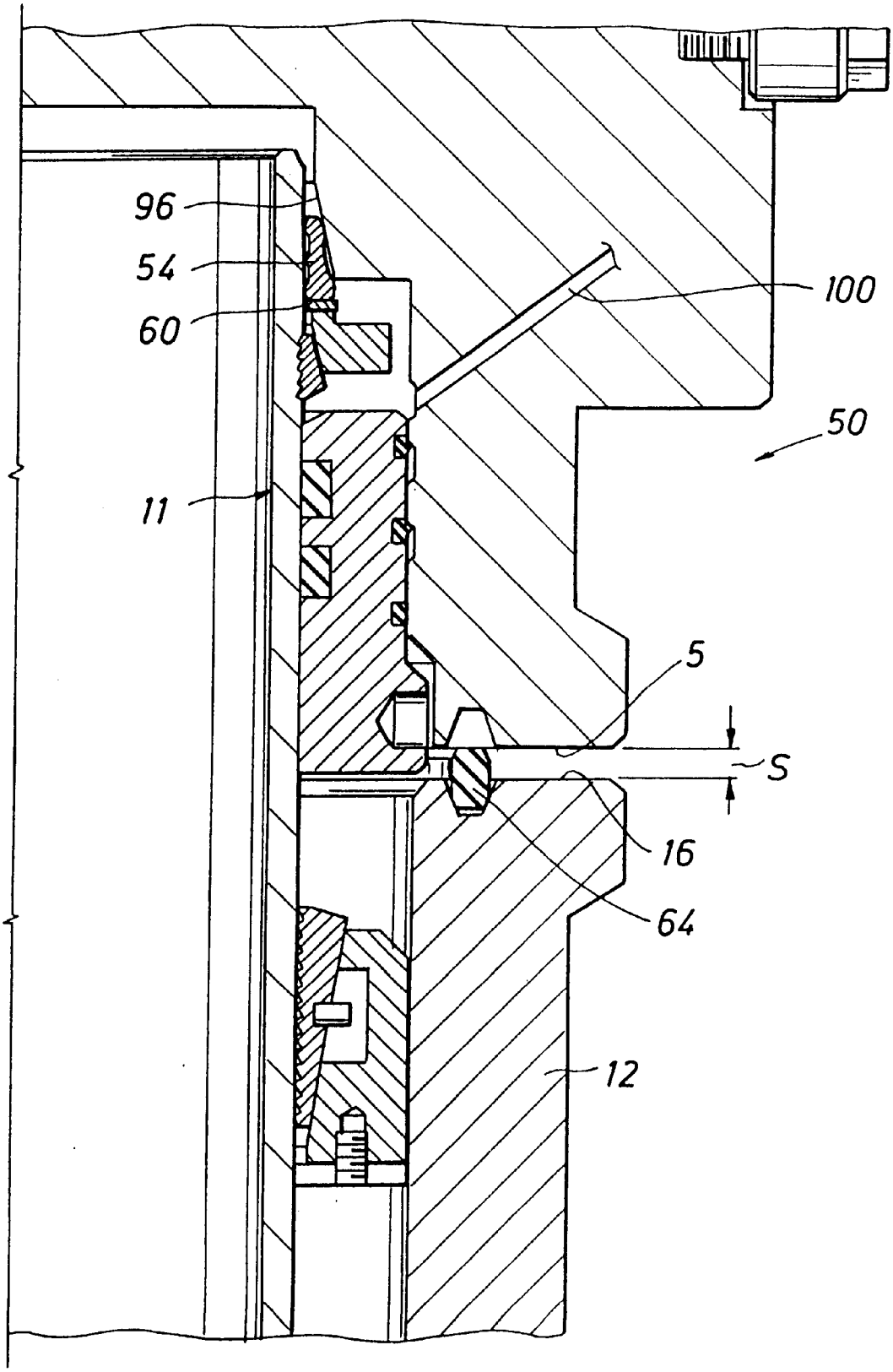
FIG. 14 shows the tubing head installed over the casing stub and seal assembly ready to energize the soft metal seal.

As illustrated in FIG. 14, the tubing head 50 is installed over the casing stub 11 and seal assembly. After the tubing head is leveled, the resulting stand off S is measured.

Figure 15:
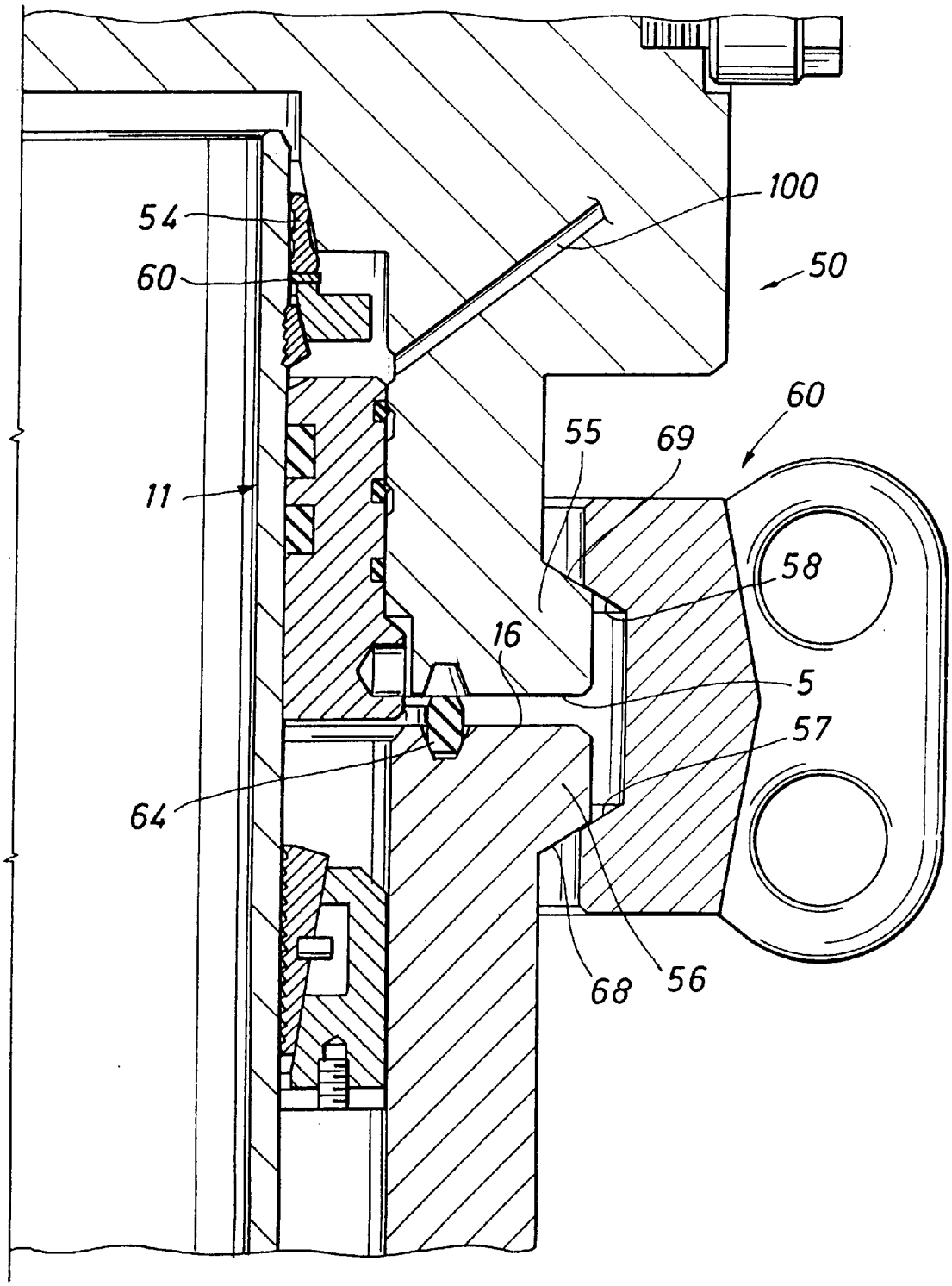
FIG. 15 illustrates a connector clamp installed over flanges of the casing head and the tubing head ready to make up the metal seal.
Figure 16:
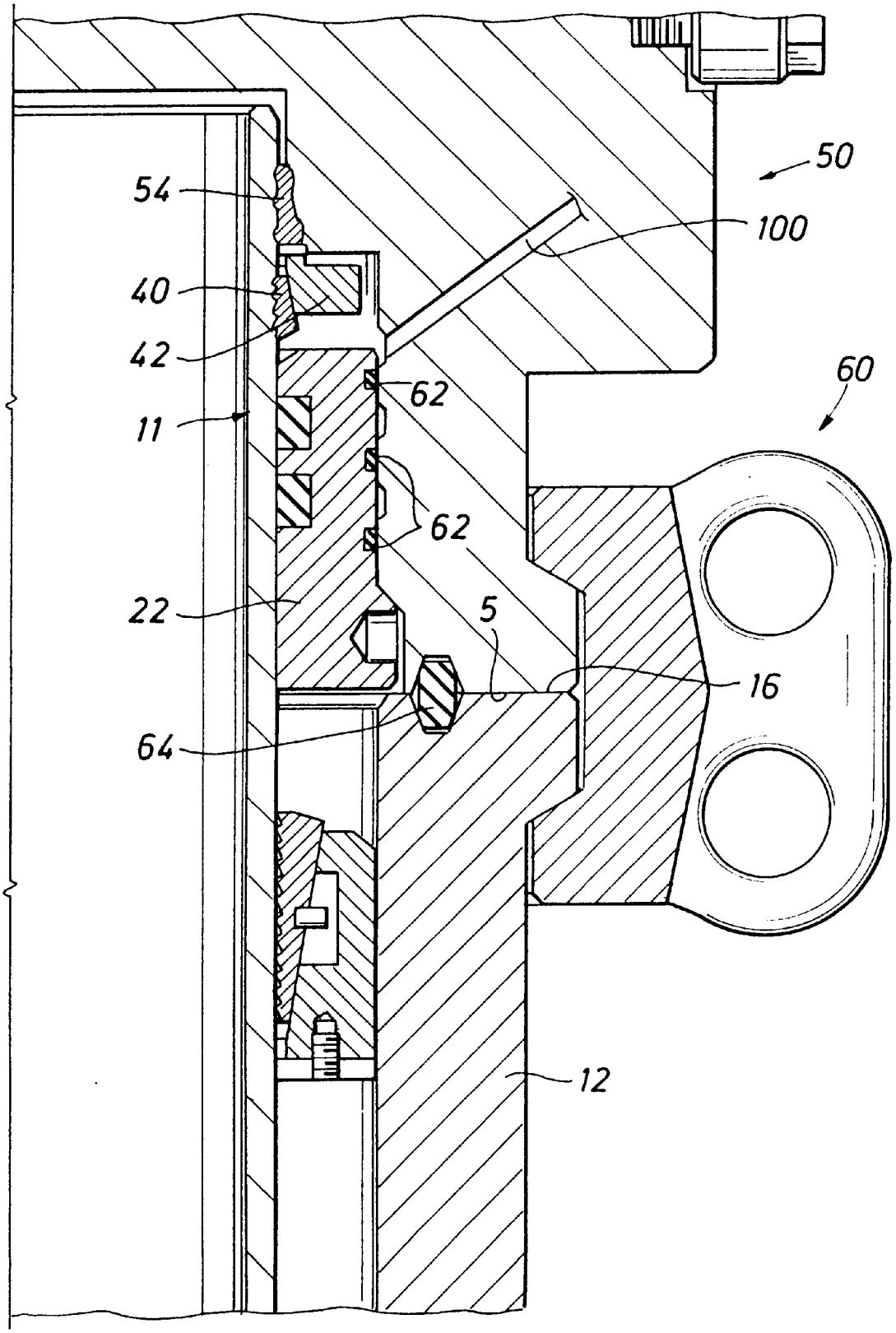
FIG. 16 illustrates the connection made up evenly with the metal seal between the casing stub and the tubing head with the metal seal supported solely by the casing stub.

Next, as illustrated in FIG. 15, connector 60 is positioned such that its inclined shoulders 57, 58 are in contact with shoulders 68, 69 of flanges 55 and 56. The connector 60 is then energized to force the hub face 16 and the tubing head face 5 into face-to-face contact. The connection of tubing head 50 and casing head 12 is now ready for testing. When the FX RCMS seal 54 is tested by applying pressure via port 100, 80% of casing collapse pressure should not be exceeded. Alternatively, a 10,000 psi limit should be observed if a cup tester is used in the casing.

If a test procedure were to result in failure, the tubing head 50 is removed and the FX RCMS seal 54 is removed with a power wheel cutter. Care must be taken to insure that the casing stub 11 is not damaged during such operation. The seal surface of the casing is cleaned again with a wire brush and the applicable steps described above are repeated.

While preferred embodiments of the present invention have been illustrated and/or described in some detail modifications and adaptions of the preferred embodiments will occur to those skilled in the art. Such modifications and adaptations are within the spirit and scope of the present invention.

What is claimed is:

1. A method of installing an annular metal seal (54) about the outer rough surface of a casing (11) projecting upwardly above a casing head (12), the metal seal arranged and designed to be energized for sealing between the casing and a tubing spool mounted on the casing head after the metal seal has been positioned on the casing; said method comprising the steps of:

installing a bushing (22) around said outer rough surface of said casing at a position above said casing head (12);

positioning a slip mechanism (40) about the outer periphery of said casing (11) for support from a top surface of said bushing (22), said slip mechanism having a gripping face which engages the casing (11);

positioning a cam member (42) about a cam surface of said slip mechanism in preparation for engaging the slip mechanism (40) to urge the slip mechanism into biting engagement with the outer surface of the casing;

exerting a downward force against the cam member to cam said slip mechanism inwardly into tight gripping relation with the casing with downward movement of the slip mechanism (40) resisted by the said bushing;

next, positioning a metal seal (54) over the end of said casing (11) with axial support of said metal seal (54) by said slip mechanism (40); and next, mounting a tubing spool (50) about said outer rough surface of said casing (11) and connecting said tubing spool (50) to said casing spool (12) with an inner peripheral surface of said tubing spool (50) engaging said metal seal (54) for forcing said seal radially into sealing relation with the outer surface of said casing (11).

2. The method of claim 1 wherein, said metal seal is fabricated of relatively soft metal.

3. The method of claim 2 wherein, said metal seal is fabricated of stainless steel AISI 316 and is characterized by a UNS name of 531,600 with a Rockwell "B" of 83 HRB Max and a yield strength of 30,000 psi min.

4. A method of installing an annular metal seal (54) about an outer rough surface of a casing (11) which projects upwardly above a casing head (12), said metal seal (54) adapted to be energized for sealing between said casing (11) and a tubing head (50), the method comprising the steps of:

installing a slip mechanism (40, 42) for supporting and positioning said metal seal (54) about the outer periphery of the casing (11), said slip mechanism including slips (40) having teeth for engaging the casing and a cam member (42) for urging the slips (40) into biting engagement with an outer surface of the casing;

installing a bushing (22) about said casing below said slip mechanism for support of said slip mechanism;

positioning a slip installing tool (18) having a push ring (44) over the upper end of said projecting casing (11) onto said casing head (12) with said push ring (44) engaging said cam member (42);

forcing said cam member (42) downwardly with said slip installing tool (18) for moving said slips (40) inwardly to grip said casing (11) with the cam member (42) remaining in position adjacent the slips; then, removing the slip installing tool (18) from the upper end of said casing (11) while the slips (40) and said cam member (42) remain in position on said casing (11);

then, positioning said metal seal (54) over a top end of said projecting casing (11) while being supported against an upper surface of the cam member (46); and next, placing a tubing head (50) over the upper end of said casing (11) and connecting a lower end of said tubing head (50) to an upper end of the said casing housing (12) with an inner peripheral surface of said tubing head (50) engaging said metal seal (54) for urging said metal seal (54) into sealing relation with the outer surface of said casing.

5. The method of claim 4 further comprising the steps of, prior to connecting said lower end of said tubing head (50) to said upper end of said casing head (12), measuring the axial distance between the bottom end of said tubing head (50) and the top end of said casing head (12);

then removing said tubing head (50) from said casing (11);

placing at least one shim (60) between said metal seal (54) and said cam member (42) to insure that the bottom end of said tubing head (50) and the top end of said casing head (12) is separated by a predetermined axial distance; and again placing said tubing head (50) over the upper end of said casing (11).

6. The method of claim 4 wherein, when said cam member (42) is forced downwardly for camming said slips radially inward toward said casing (11), said bushing (22) axially supports said slips and limits axial movement of the cam member (42) during the camming action.

7. The method of claim 4 further including the steps of:

installing screws (24) on said slip installing tool (18) for said bushing (22); and actuating said screws (24) to engage said bushing (22) and position said bushings (22) accurately on said casing (11).

8. A metal-to-metal sealing arrangement for sealing about the outer rough surface of a casing (11) projecting from the upper end of a casing head (12); said sealing arrangement comprising:

slips (40) having teeth arranged and designed to grip the casing;

a cam member (42) arranged and designed to force the slips (40) radially into engagement with said casing (11) when forced downwardly toward said wellhead housing;

a metal seal (54) positioned about the casing (11) above the slips (40) and carried by the slips (40); and a tubing head (50) positioned over the casing (11) and abutting the casing head (12) and having an inner peripheral sealing surface (96) in contact with said metal seal (54) to deform said metal seal against the rough outer surface of the casing (18) while said seal is carried by said slips (40).

9. The metal-to-metal sealing arrangement of claim 8 wherein, said tubing head (50) and said casing head (12) have mating flanges (16, 5); and a fastener (60) clamps said mating flanges together.

10. The metal-to-metal sealing arrangement of claim 8 further comprising, a bushing (22) mounted about said casing (11) for supporting said slips (40) when said slips (40) are forced inwardly to grip said casing (11) when said cam member (42) is forced downwardly, said bushing (22) being positioned in an annular space between said casing (11) and said tubing head (50), said bushing 22 also providing a second sealing member for testing of said metal seal (54).

11. The metal-to-metal sealing arrangement of claim 10 wherein, said bushing (22) is coupled to said casing housing (12) during camming of said slips (40) by said cam member (42) into gripping relation thereby to oppose the forces exerted by the camming action.

12. Apparatus for applying an annular metal seal (54) about an outer rough surface of a casing (11) projecting from the upper end of a casing head (12) with the metal seal (54) adapted to be energized for sealing between the casing (11) and a tubing head (50); said apparatus comprising:

a slip assembly mounted on an end portion of the casing which projects upwardly above the casing head (12); the slip assembly including slips (40) having teeth which are arranged and designed to engage the casing (11), a cam member (42) for forcing the slips (40) into gripping engagement with the casing (11), and a bushing (22) below the slips for supporting the slips at a predetermined position on the casing;

a tool (18) for forcing the cam member (42) to cam the slips (40) to grip the casing (11) while supported on said slip support (22);

a metal seal ring (54) positioned about the casing (11) above the slips (40) and carried by the slips; and a tubing head (50) positioned over an end of the casing (11), said tubing head (50) arranged and designed to abut the casing head (12) and having an inner peripheral sealing surface (96) which contacts said metal seal ring (54) to deform said metal seal ring (54) against the rough outer surface of the casing (11) for providing a metal seal between the tubing head (50) and the casing (11) where said tubing head (50) is connected to said casing head.

13. The apparatus of claim 12 wherein, said tool for forcing the cam member (46) includes a hydraulic piston (30) and a push ring (44) arranged to engage the cam member (42) and for forcing the cam member (42) downwardly against the slips (40), said bushing (22) limiting axial movement of said slips (40) as said cam member (42) is pushed downwardly.

14. The apparatus of claim 12 wherein, at least one shim (60) is positioned between said cam member (42) and said annular metal seal (54), said shim arranged and designed to create a predetermined spacing (S) between a bottom surface (5) of said tubing head (50) and a top surface (16) of said casing head after positioning of said tubing head over said casing (11) but before connection of said tubing head (50) to said casing head (12).

15. A slip installation tool and slip assembly arrangement where the slip assembly is arranged and designed to fit over the upper end of a casing (11) which projects upwardly from a casing head (12) in which the casing (11) is positioned; the arrangement comprising:

an outer cylindrical wall (19) having an open lower end to receive a projecting end portion of the casing (11) and abutting against the casing head (12);

a slip assembly mounted within the open end of the tool including a bushing (22) for fitting about the casing, slips (40) supported on said bushing (22) and a cam ring (42) which engages an outer surface of the slips (40) for urging the slips (40) inwardly; and a piston (30) coupled to said cam member (42) which exerts a downward force on the cam member (42) to force the slips (40) inwardly to grip the outer surface of the casing (11).

16. The arrangement of claim 15 wherein, said piston (30) is coupled to said cam member (42) via an energizing ring (44) placed between a bottom surface of said piston (30) and a top surface of said cam ring.

* * * * *